United States Patent [19]

Wikdahl

[11] 3,959,123

[45] May 25, 1976

[54] HYDROCYCLONE SEPARATOR UNIT WITH DOWNFLOW DISTRIBUTION OF FLUID TO BE FRACTIONATED AND PROCESS

[76] Inventor: Nils Anders Lennart Wikdahl, 42 Bravallavagen, 182 64 Djursholm, Sweden

[22] Filed: Aug. 6, 1973

[21] Appl. No.: 386,236

[30] Foreign Application Priority Data

Oct. 4, 1972 Sweden ..... 12809/72

[52] U.S. Cl. ..... 209/211; 210/512 M

[51] Int. Cl.[2] ..... B04C 5/28

[58] Field of Search ..... 209/211, 144; 210/512; 55/349

[56] References Cited

UNITED STATES PATENTS

| | | | |
|---|---|---|---|
| 2,806,550 | 9/1957 | Westlin | 55/349 X |
| 3,335,860 | 8/1967 | Baxter | 209/211 |
| 3,415,374 | 12/1968 | Wikdahl | 209/211 |
| 3,598,731 | 8/1971 | Frykhult et al. | 210/512 M X |
| R25,099 | 12/1961 | Hoffmann | 209/211 X |

FOREIGN PATENTS OR APPLICATIONS

| | | | |
|---|---|---|---|
| 328,653 | 5/1930 | United Kingdom | 209/144 |
| 1,054,401 | 2/1954 | France | 209/144 |
| 1,156,287 | 6/1969 | United Kingdom | 209/144 |

*Primary Examiner*—Frank W. Lutter
*Assistant Examiner*—Ralph J. Hill

[57] ABSTRACT

A hydrocyclone separator unit is provided having an array of cyclone separators arranged in a plurality of superimposed layers, and oriented at least approximately horizontally, with common distributing and collecting chambers for liquid suspension to be fractionated and for the respective fractions obtained therefrom, and featuring downflow distribution of liquid suspension to be fractionated to the several layers of hydrocyclone separators in the array.

A process also is provided for fractionation of liquid suspension in hydrocyclones arranged in superimposed layers in which the liquid proceeds at least in part by downflow to the several layers of hydrocyclones.

32 Claims, 9 Drawing Figures

HYDROCYCLONE SEPARATOR UNIT WITH DOWNFLOW DISTRIBUTION OF FLUID TO BE FRACTIONATED AND PROCESS

During the past 20 years, hydrocyclones have come into wide use for the fractionation of cellulose pulp suspensions. This development has followed the introduction in 1955 of apparatus including an array of such hydrocyclones arranged radially within a housing. The system is described by Hoffmann in U.S. Pat. No. 2,956,679 issued Oct. 18, 1960, U.S. Pat. No. 25,099, reissued Dec. 19, 1961, based on an application filed in Sweden in 1954, where this type of cyclone separator was first developed.

Hydrocyclones have a conical chamber of circular transverse cross-section, into which chamber the liquid to be fractionated is introduced tangentially at the larger end, thereby creating a whirling motion within the chamber, giving rise to a vortex, and causing the larger or coarser particles to be thrown outwardly by the centrifugal force. The larger particles leave the chamber at an outlet through the apex of the cyclone. The smaller or finer particles leave the chamber through a centrally arranged outlet at the base of the cyclone.

Hoffmann provided an apparatus including an array of such hydrocyclones in a housing. A plurality of the hydrocyclones are arranged radially in approximately the same plane, with the apices of the hydrocyclones turned toward each other. The hydrocyclones are enclosed in a casing, which provides a common supply chamber for the dispersion to be fractionated in such a manner that the hydrocyclones are surrounded by the dispersion. The supply chamber is preferably circular, with its axis at least approximately at right angles to the axes of the chambers. The apices and bases of the hydrocyclones also open into common fraction collection chambers, in which the apex fraction and base fraction are collected.

As seen in FIG. 1 of the patent, the pulp suspension is supplied through the conduit 1 at the top of the housing, and passes through the radial pipe conduits 2 into the circular feed conduit 3, and from there through the connecting conduits 4 to the inlets for the individual hydrocyclones 6 of the array. From the conduits 2, the pulp suspension flows up to the hydrocyclones above it, and down to the hydrocyclones below it. The coarser fraction or rejects passes through the openings 10 in the apices of the hydrocyclones, and is collected in the central chamber 7, from which it is drawn off through a conduit 12, while the lighter fraction or accepts is withdrawn at the base end of the hydrocyclones via pipes 9 into the annular chamber 8, and passes to a collecting vessel 14, whence it is withdrawn through the pipe conduit 15. In this way a larger number of hydrocyclones can be placed in a relatively small space.

Nonetheless, the capacity of an array of hydrocyclones of this type was insufficient for large pulp mills, and consequently Wikdahl U.S. Pat. No. 3,261,467, patented July 19, 1966, provided another arrangement. Within a single housing, Wikdahl provided a plurality of cyclones stacked in several parallel layers, in each of which the cyclones are radially disposed, with the apices facing the central axis of the stack. The cyclones are supported by several concentrically-disposed tubular members, defining together with the end walls several separate annular chambers. The inlet fluid flow containing the liquid to be fractionated is fed in from the bottom, proceeding upwardly through the annular chamber 8 to the individual hydrocyclones of the array. Another annular chamber 13 is provided in which accepts fraction from the base of the hydrocyclones is collected, at the outer periphery of the array, and a central chamber 12 is provided for collecting the rejects fraction from the apices of the hydrocyclones.

All the connections to the cyclone assembly are effected through the manifold or socket 20. This permits an installation of the assembly so that the manifold and the conduits connected thereto are disposed in a pit or below floor level, so that the only part visible above floor level is the outer casing 14. This permits a convenient servicing of the hydrocyclones by lifting the casing, without any danger to the conduits or other connections, while the central disposition of the feed duct and the limited throttling of the flow at the outlet ports ensures a uniform distribution of the liquid among the hydrocyclones of the assembly.

While this design of hydrocyclone separator array has been extremely successful commercially throughout the world, particularly in the separation of cellulose pulp suspensions, some problems in use have arisen in certain mills. For practical reasons, the distributing and collecting chambers are shaped with constant cross-sectional area from the bottom to the top of the array. This means that the flow velocity of the material to be separated decreases as the flow proceeds upwardly from the bottom of the array, so that the lowest flow velocity is found in the uppermost part of the distributing chamber. Air and other gases accumulate at the top of the chamber, and because of the presence of air and moisture, bacteria, molds, slime and other microorganisms and plant life may grow actively, relatively undisturbed by this flow. The result is that undesirable deposits may be formed on the walls of the chamber, as well as on the outsides of the hydrocyclone separators. These can accumulate to the point when they seriously interfere with the operation of the hydrocyclones in the upper portion of the array, and even before this stage as they accumulate they reduce the efficiency and output of the array.

Accordingly, to avoid such interference, and possibly an ultimate breakdown in operation, it is necessary at regular intervals to shut down the array, and clean out the air and other gases, bacteria, slime, molds, and other deposits. This naturally is expensive, besides resulting in lost production through that unit.

Recently, Frykhult et al. U.S. Pat. No. 3,598,731, patented Aug. 10, 1971, provided another type of hydrocyclone separator array, in which the individual hydrocyclones were arranged radially, but with their base ends facing inwardly, and the apices facing outwardly. Frykhult et al. claimed that it is advantageous to observe the reject outlet during operation, and if the reject outlet faces outwardly, it can also be cleaned more readily. Frykhult et al. pointed out that if the reject outlets in a number of hydrocyclones are plugged and therefore inoperative, a proportion of the pulp suspension may flow unchanged through the array, resulting in an imperfectly separated product. Frykhult et al. also arranged the inlet 5 at the bottom of the array, as seen in FIG. 1, and provided a distribution chamber of uniform diameter from bottom to top of the array, so that this device has the same problems in this respect as the Wikdahl device.

In accordance with the invention, it has been determined that if the flow direction of the inlet feed of the liquid to be fractionated to the layers of hydrocyclones in the array of the Wikdahl and Frykhult et al. patents is modified so as to proceed at least in major proportion in downflow, descending to the several layers of hydrocyclones in the array with any remaining portion of the flow in upflow, the difficulties arising from the accumulation of air and other gases and also bacteria, molds, slime and other plant life are overcome, and deposits do not form on the walls of the chamber and on the outsides of the hydrocyclones. It is believed that in part at least this is due to the fact that the flow rate in the upper portion of the apparatus is then at least as high as anywhere else in the array.

All of the flow may proceed in downflow. It is however quite advantageous if part proceeds in downflow and part in upflow, so as to increase circulation and cross currents in the distribution chamber of the apparatus adjacent the hydrocyclones.

In addition, as a further feature, the volume of the distribution chamber can be reduced in the direction from top to bottom of the array, to compensate for the reduced volume of fluid as liquid enters the hydrocyclones of the arrays above, thus accommodating the lower flow while maintaining substantially the same flow rate within the distribution chamber from the top to the bottom of the array.

In the apparatus of the invention, such downflow feed of material to be separated can be accommodated by placing the feed inlet in the upper portion of the housing, or by retaining the inlet in the lower portion of the housing, but providing a feed conduit that leads the feed directly to the top at or above the uppermost layer of hydrocyclones in the unit, from which point the material proceeds by downflow to the other layers of separators in the unit.

An upflow feed of material to be separated can be accommodated by placing or retaining a supplemental feed inlet in the lower portion of the housing, so that a part in any event not more than about 75% of the feed also proceeds to the bottom or below the lowermost layer of hydrocyclones in the unit, from which point the material proceeds by upflow to the other layers of separators in the unit.

It is also possible to place further supplemental feed inlets in the intermediate portion of the housing, so that a part of the flow is led directly to intermediate layers of hydrocyclones in the unit. These also increase circulation and cross-currents in the distribution chamber.

Accordingly, the invention provides a hydrocyclone separator unit comprising an array of hydrocyclones arranged in a plurality of superimposed layers, each hydrocyclone having a conical vortex chamber having a base end provided with an inject inlet and a base outlet and an opposed apex end provided with an apex outlet; a first separating wall along which the hydrocyclones are distributed in layers, one above the other, and defining a collection chamber common to and communicating with a plurality of the vortex chambers by way of the outlets at one end of the hydrocyclones; a second separating wall along which the hydrocyclones are distributed in layers, one above the other, and defining a collection chamber common to and communicating with a plurality of the vortex chambers by way of the outlets at the other end of the hydrocyclones; a distribution chamber intermediate the first and second walls common to and communicating with a plurality of the vortex chambers by way of the inject inlets; and means for feeding at least 25% up to 100% of the liquid suspension to be fractionated in downflow, descending from the uppermost to the lowermost of the superimposed hydrocyclone layers, any portion remaining of the liquid being fed in upflow or horizontal flow to the hydrocyclone layers. Preferably, both the base and the apex outlets are axial, but the base outlet can be lateral without disadvantage, and the apex outlet can also be lateral. The hydrocyclones can be arranged radially in the array about a central axis, with the apices either facing towards the central axis, or facing the outer periphery of the array.

Also provided in accordance with the invention is a process for fractionating liquid suspensions in an array of hydrocyclones arranged in a plurality of superimposed layers, the hydrocyclones having an elongated vortex chamber having a base end provided with an inject inlet and a base outlet, and an opposed apex end provided with an apex outlet, which comprises feeding at least 25% up to 100% of the liquid suspension to be fractionated to the inject inlets of the hydrocyclones in the array by downflow from the uppermost to the lowermost of the superimposed layers of hydrocyclones, any remaining portion of the liquid being fed in upflow or in horizontal flow to the layers of hydrocyclones, passing the liquid suspension into the elongated vortex chamber, fractionating the liquid suspension in the vortex chamber so as to produce a light and a heavy fraction which are separated at the axial base outlet and axial apex outlet, respectively, and then separately collecting the light and heavy fractions.

Preferred embodiments of the invention are illustrated in the drawings in which.

Figure 2:
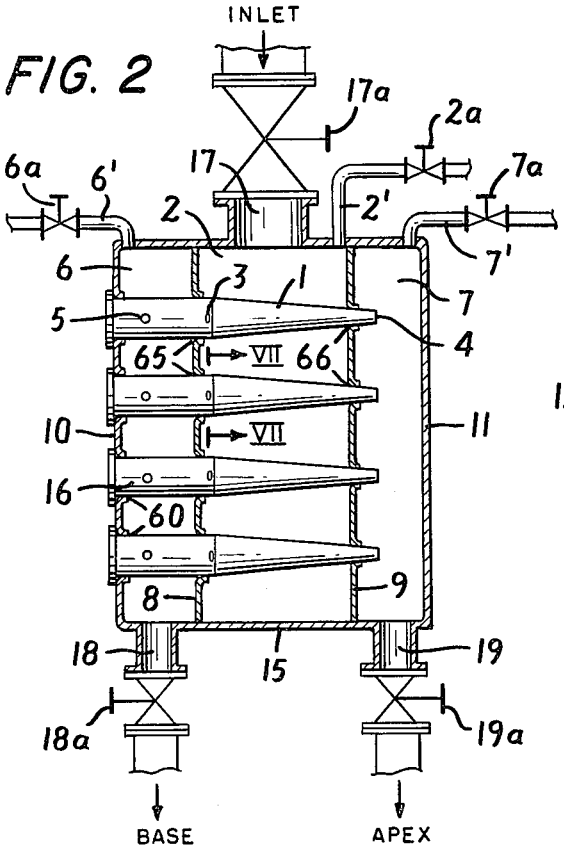
FIG. 2 is a vertical section of the array of FIG. 1, taken along the line II—II of FIG. 1.
Figure 7:
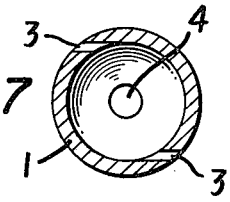
Figure 8:
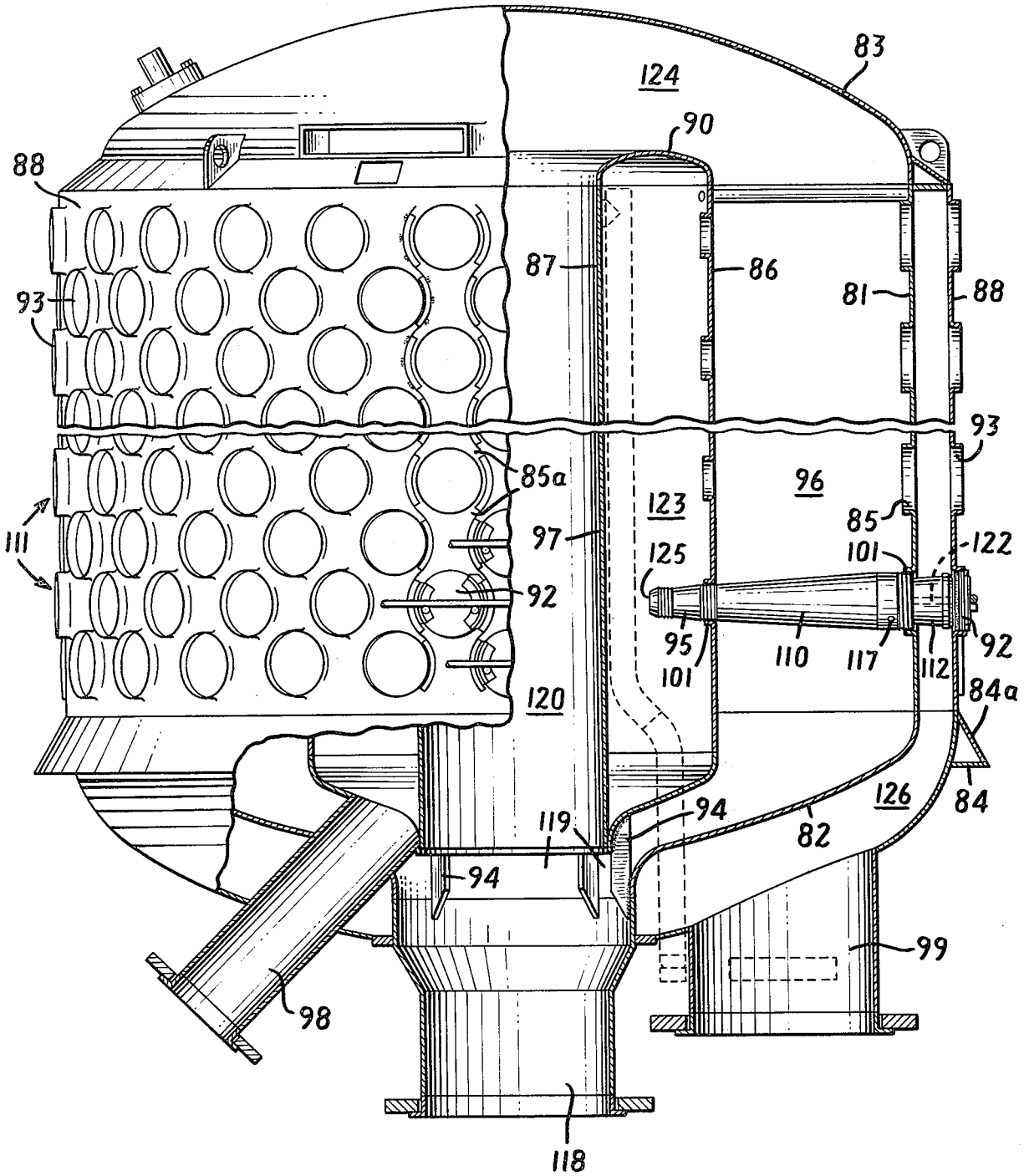
Figure 9:
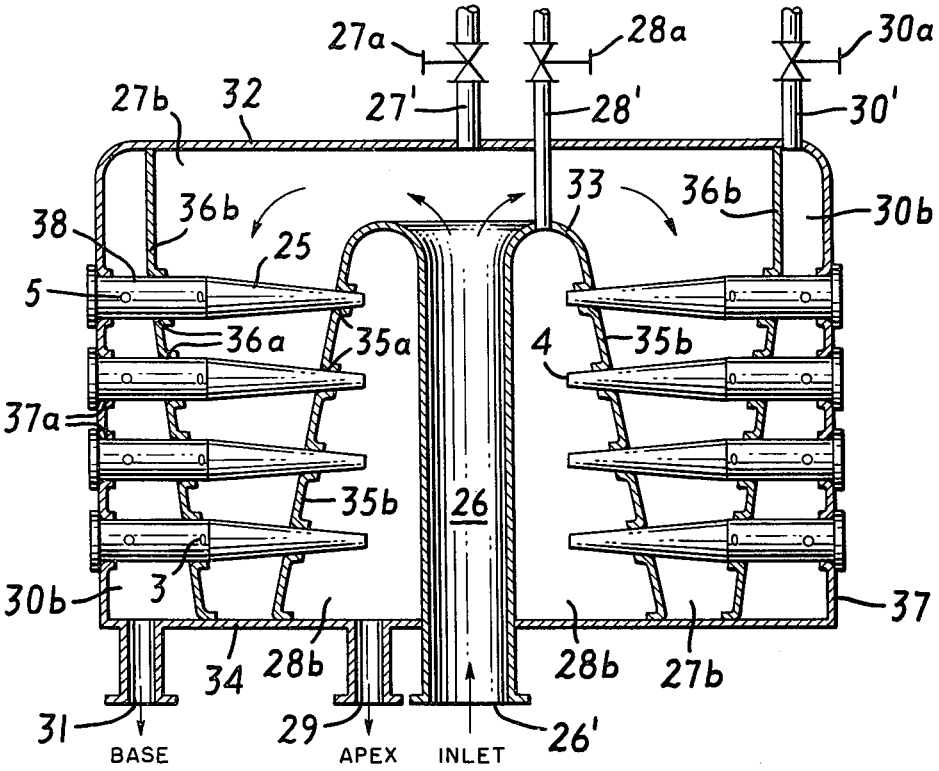

FIG. 7 is a horizontal section taken along the lines VII—VII of FIG. 2, showing in cross-section the inlet to an individual hydrocyclone of that array; and FIG. 8 represents schematically, in longitudinal section, an apparatus in accordance with the invention in which provision is made for both downflow and upflow feed of liquid to be fractionated to the layers of hydrocyclone separators; and FIG. 9 is a vertical section of another embodiment of hydrocyclone separator array in accordance with the invention.

Figure 1:
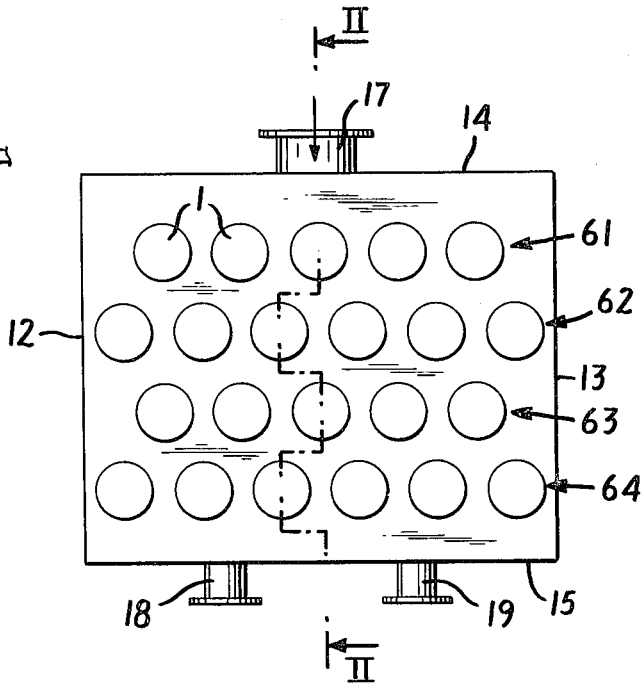
FIG. 1 represents a side view of a hydrocyclone separator array in accordance with the invention.

The hydrocyclone separator unit shown in FIGS. 1 and 2 has external side walls 10, 11, and top and bottom walls 14, 15, of which side wall 10 has a plurality of spaced apertures 60 therethrough, in which are mounted the base ends of a plurality of hydrocyclone separators 1, arranged in four superimposed parallel layers or groups 61, 62, 63, 64 having their geometric axes horizontal.

Extending from top 14 to bottom 15 of the housing are walls 8, 9. These walls are provided with a plurality of apertures 65, 66, within which are received the central portion and apex ends 4 of the individual hydrocyclone separators 1, which are thus mounted in and supported by the walls 8, 9, 10.

Between walls 8 and 10 is defined a collection chamber 6, common to all the separators 1 from top to bottom of the several layers of the array. Between walls 8 and 9 is a distribution chamber 2, and between walls 9 and 11 is a collection chamber 7, each of which also extend from top to bottom of the housing, and are common to all of the hydrocyclone separators of the array.

The chamber 2 serves as a distributing chamber for feed liquid to be fractionated to the individual hydrocyclone separators. As best seen in FIG. 7, each hydrocyclone separator 1 is provided with two tangentially arranged inlets 3 in fluid flow connection with the distributing chamber 2. Fluid entering the inlets 3 at a relatively high flow rate because of the tangential arrangement of the inlets is given a circular cyclonic rotating motion which results in the centrifugal separation of the components, with the result that the heavier components are thrown to the periphery of the inner chamber of the hydrocyclones, and moves towards the apex outlets 4, while the lighter material remains in the central portion of the hydrocyclone, and moves towards the base end outlets 5, of which at least one and preferably two or three are provided laterally at the base of each hydrocyclone. It will be seen from FIG. 2 that the lateral openings 5 discharge material at the base end of the hydrocyclone to the collection chamber 6, which consequently collects light fraction or accepts, while material passing through the apex outlets 4 passes into the collection chamber 7, which accordingly collects the heavier fraction or rejects.

The housing 11 has an inlet 17 at the top for liquid to be fractionated, provided with a valve 17*a* for controlling flow of fluid through the inlet, and this inlet is in fluid flow connection with the distribution chamber 2. At the base of the housing 11 are two outlets 18, 19, of which outlet 18 is in fluid flow connection with the collection chamber for the light or accept fraction 6, and is provided with a valve 18*a* for controlling flow of accept fraction through the outlet 18. The outlet 19 is in fluid flow connection with the collection chamber 7 for rejects, and the flow of heavy fraction or rejects through the outlet 19 is controlled by the valve 19*a*.

At the top of the collection chamber 6 is an outlet 6' controlled by a valve 6*a* for air or other gases, and at the top of the collection chamber 7 is a similar outlet 7' controlled by a valve 7*a* for air or other gases. At the top of the distributing chamber 2 is an outlet 2' controlled by a valve 2*a*, for discharge of air or other gases. Thus, is it possible to avoid the accumulation of gases at the tops of each of these chambers.

In operation, the liquid to be fractionated is fed to the distribution chamber 2 through the inlet 17, with the flow being controlled by the valve 17*a*. The fluid then proceeds by downflow through the chamber 2, entering the several inlets 3 of the hydrocyclone separators of the array. The heavier fraction or rejects passes through the apex outlets 4 of the hydrocyclone separators into the collection chamber 7, and is removed through the outlet 19, flow being controlled by the valve 19*a*, while the lighter fraction or accepts passes through the outlets 5 of the individual hydrocyclone separators into the collection chamber 6, and then through the outlet 18, flow being controlled by the valve 18*a*. Air and other gases that may be accumulated are vented through the outlets 2', 6',7', thus preventing the accumulation of gases at the top of the chambers. The downflow arrangement prevents the accumulation of bacteria, slime, molds and other organisms at the top of the collection chamber. These presumably are swept out of the unit with the fluid flow through one of the several outlets 18, 19.

Figure 3:
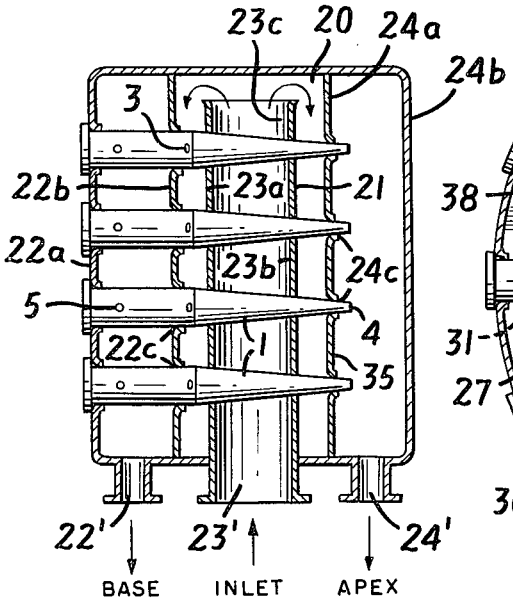
FIG. 3 is a vertical section of another embodiment of hydrocyclone separator array in accordance with the invention.

In the hydrocyclone separator unit shown in FIG. 3, the inlet is arranged at the bottom of the housing, as also are the base and apex outlets for accepts and rejects, respectively. In this case, an annular distribution chamber 20 is provided, defined between walls 22*b*, 24*a*, which are provided with apertures 22*c*, 24*c* through which pass the central portions and apex ends 4 of the individual hydrocyclones 1. Between the walls 22*b*, 24*a* is the inlet conduit 23, which, defined by the walls 23*a*, 23*b*, has no exit except at the top 23*c*, whence the fluid must pass over the top of the walls 23*a*, 23*b* and then can flow downwardly through the annular distribution chamber 20, which is in fluid flow connection with the inlets 3 of the hydrocyclone separators 1.

The individual hydrocyclones are arranged so that their apex end outlets 4 are in fluid flow connection with the collection chamber 24, which is defined by the walls 24*a*, 24*b*, while the outlets 5 at the base end of the hydrocyclone separators 1 are in fluid flow connection with the collection chamber 22, defined between the walls 22*a* and 22*b*. Thus, the light fraction or accepts passes through the outlets 5 into the collection chamber 22, and thence through the outlet 22', while the rejects or heavier fraction passes through the apex end outlets 4 into the collection chamber 24 and thence to the outlet 24'. If desired, the inlets and outlets can be provided with control valves, as shown in FIG. 2.

Figure 5:
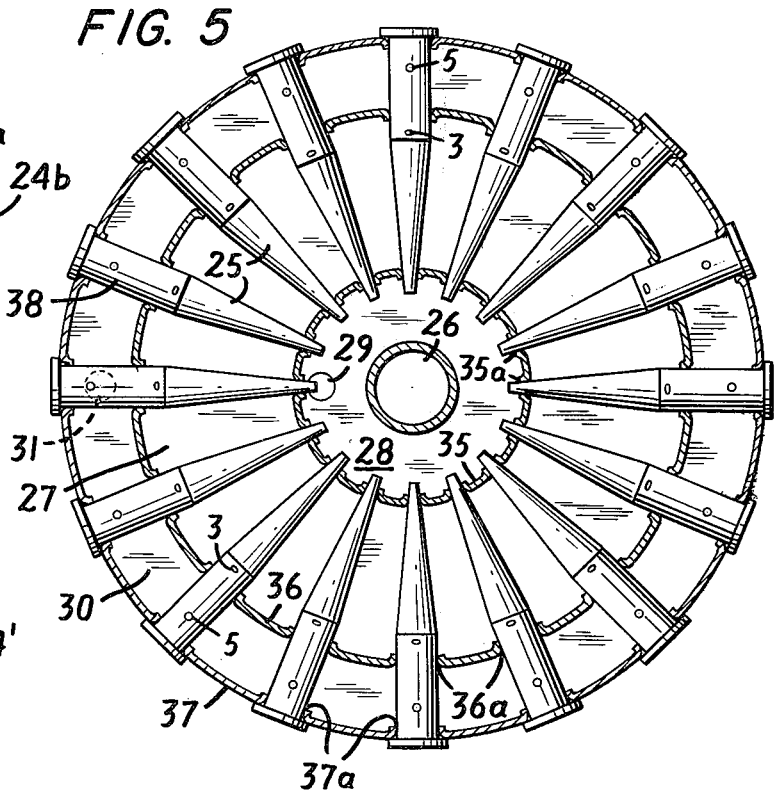
FIG. 5 is a horizontal section taken along the line V—V of the array of FIG. 4.
Figure 4:
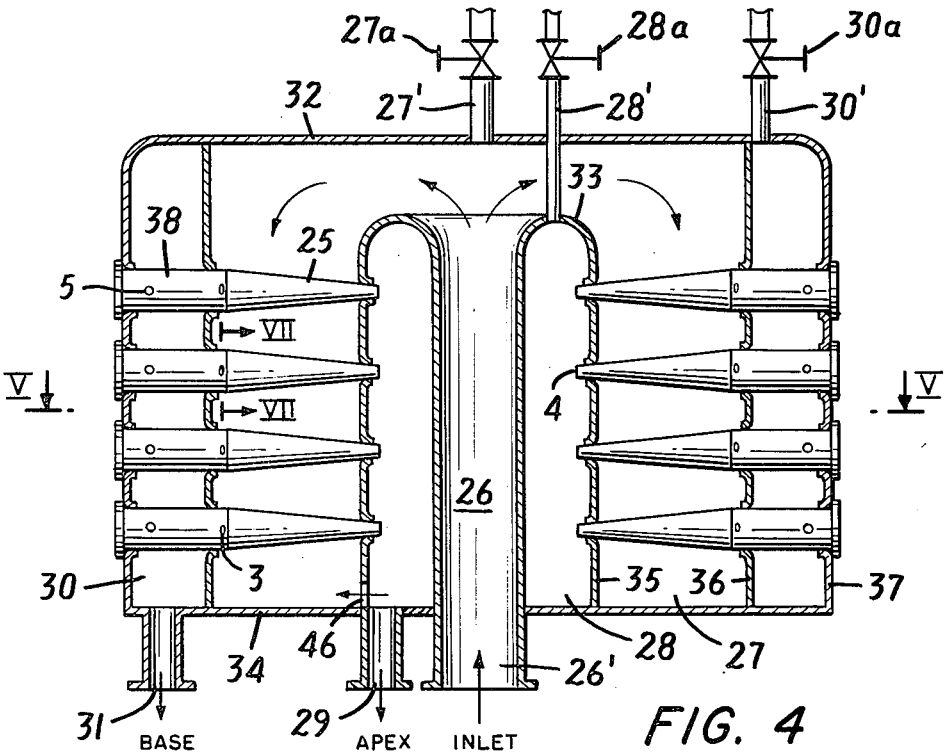
FIG. 4 is a vertical section of another embodiment of hydrocyclone separator array in accordance with the invention.

The hydrocyclone separator unit shown in FIGS. 4 and 5 has an array of hydrocyclone separators 25 horizontally and radially disposed in four superimposed layers, with their apex ends facing the center.

The separator unit has an external cylindrical housing 37, within which are arranged two concentric tubes 35, 36. All three tubes or cylinders are provided with a plurality of apertures 35*a*, 36*a*, 37*a*, through which pass the individual hydrocyclones separators 25, which accordingly are supported by these tubes.

Within the innermost tube 35 is a central feed tube 26, in fluid flow connection with the inlet 26'. The feed tube 26 proceeds from the bottom to the top wall 32 of the housing where it is in fluid flow connection with the distribution chamber 27, defined by tubes 35, 36. The inlets 3 of the individual hydrocyclone separators 25 are in fluid flow connection with the distribution chamber 27. Between the tubes 36 and 37 is a collection chamber 30, which is in fluid flow connection with the outlets 5 at the base end of the individual hydrocyclone separators. Consequently, the chamber 30 serves as a collection chamber for the accepts or light fraction.

Between the inlet tube 26 and the innermost tube 35 is defined an annular chamber 28, which serves as a collection chamber for fluid passing through the apex outlets 4 of the hydrocyclone separators.

At the base of the housing 37 is an outlet 31, in fluid flow connection with the collection chamber 30, and an outlet 29 in fluid flow connection with the collection chamber 28, as well as the inlet 26'.

At the top of the housing 37 are provided outlet 27' controlled by valve 27a in fluid flow connection with the distribution chamber 27, outlet 28' controlled by valve 28a in fluid flow connection with the apex outlet collection chamber 28, and outlet 30' controlled by valve 30a in fluid flow connection with the collection chamber 30. Except for the outlets, the top 32 of the housing 37 is closed off. The outlets allow the escape of air and other gases, which would otherwise collect at the top of the various chambers.

If desired, the inlet and outlets can also be provided with such valves as shown in FIG. 1.

In operation, fluid to be fractionated such as an aqueous cellulose pulp suspension is passed through the inlet 26' into and through the tube 26 to the top of the housing, whence it is distributed to the top of the distribution chamber 27, through which it proceeds by downflow over the individual hydrocyclone separators 25 in the array to the bottom of the array. As it does so, fluid enters the individual hydrocyclones through the inlets 3, the tangential arrangement of the inlets imparting a cyclonic movement to such fluid as it does so. Within the hydrocyclone separators the fluid is fractionated, and the light fraction or accepts passes through the openings 5 at the base end of the hydrocyclones into the collection chamber 30, whence the fluid leaves through the accept outlet 31. The heavier fraction or rejects passes through the apex end outlet 4 of the individual hydrocyclone separators into the collection chamber 28, whence it leaves through the reject outlet 29.

As the fluid to be fractionated passes downwardly through the distribution chamber 27, the flow decreases, because of the loss of fluid into the hydrocyclone separator through the inlet 3. In order to compensate for this loss of fluid and maintain a high flow rate, a plurality of openings 46 are provided in the wall 35 between the heavy fraction collection chamber 28 and the distribution chamber 27. Heavy fraction passes through these openings in an amount sufficient to maintain the flow rate in the distribution chamber 27 at the bottom of the device, and such heavy fraction can of course be refractionated by passing through the inlets 3 without disadvantage to the quality of the accept fraction received in the collection chamber 30. In fact, such recycling of the heavy fraction may lead to an improved recovery of accepts.

Figure 6:
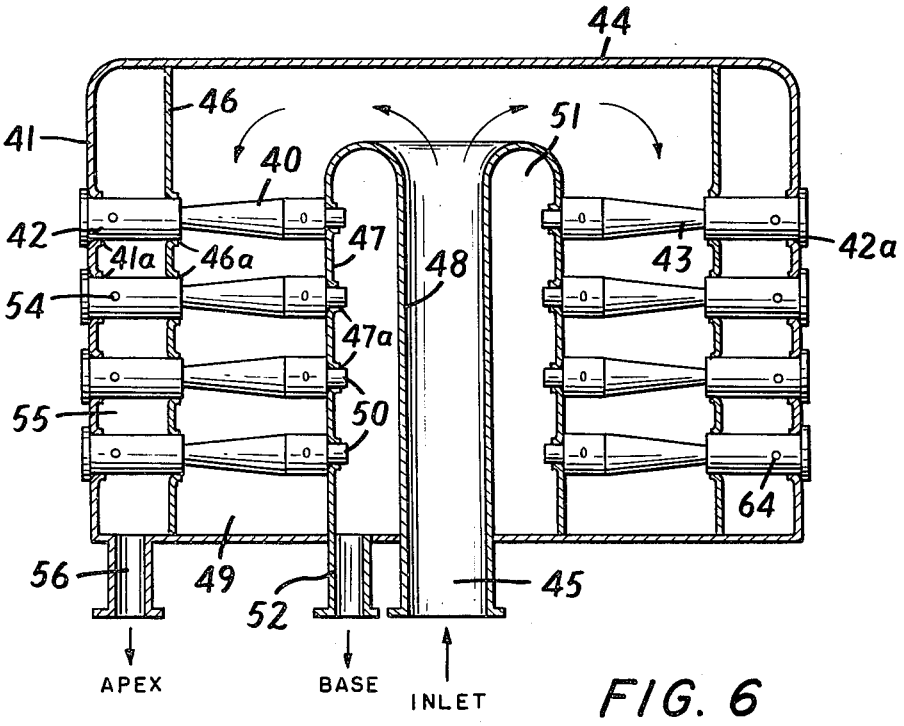
FIG. 6 is a vertical section of another embodiment of hydrocyclone separator array in accordance with the invention.

The hydrocyclone separator unit as shown in FIG. 6 is similar to that of FIGS. 4 and 5, with the exception that the individual hydrocyclone separators in the array are reversed, so that their base ends face the center, as in the Frykhult et al. device of U.S. Pat. No. 3,598,731. Despite the reversal, however, the inlets 3 of the individual separators 40 of the array are in fluid flow connection with the annular chamber 27 in the same manner as in FIG. 5.

In this case, the hydrocyclone separator unit has a housing 41 with a closed top 44 and concentric tubes or cylinders 46, 47, The tube 48 defines the inlet flow passage for fluid to be fractionated entering the housing through the inlet 45, and proceeding directly to the top of the housing, whence it enters the fluid distribution chamber 49. The cylinders 41, 46, 47, are provided with a plurality of apertures 41a, 46a, 47a, through which pass the individual hydrocyclone separators 40 of the array. The tube 47 receives the base end outlets 50 of the separators, which are in fluid flow connection with the accept collection chamber 51 defined between tubes 47, 48. This chamber has an outlet 52 for accept fraction.

At their apex ends, the individual hydrocyclone separators 40 are provided with a cylindrical extension 42, mounted in an aperture 41a in the housing 41, and fixed at its inner end in fluid-tight relationship with the apex ends 43 of the separators. It is, of course, necessary that the extension members 42 have an inner diameter sufficient to receive the outer diameter of the separators at the base end, so that these separators can be passed through the extension members to span the distribution chamber 41, and have the base end outlets inserted in the tube 47.

The extension member has its outer end closed off, preferably by a transparent plug, or the member can be made of transparent material with the end closed, so that it is possible to look into the separators and thus note visually whether the apex outlets are plugged. The extension member 42 can also be provided with a plug which can be removed, so as to make it possible to reach in and clean the apex end outlets if they are plugged.

The extension members 42 are provided with a plurality of lateral outlets 64, which are in fluid flow connection with the annular chamber 55 defined by the tubes 41, 46, which accordingly serves as a collection chamber for rejects or heavier fraction passing through the apex end outlets 43. The outlet 56 is in connection with the collection chamber 55 for removal of the rejects fraction.

If desired, the housing 41 at the top 44 can be provided with outlets as in the manner shown in FIG. 4, so that gas can be removed from the distribution chamber 49 and the collection chambers 51 and 55.

The outlets 52, 56 and the inlet 45 also can be provided with valving as in FIG. 2, if desired.

If desired, the base ends 16, 42 can be attached to the outer housing shell by means of a bayonet mount or other leaktight connection, so that they can be removed and replaced if required.

The cyclone separators in the different layers in the array can be placed one directly above the other, or offset as shown in FIG. 1. When they are offset, the distance between the individual separators can be reduced considerably, so that a more compact unit can be prepared, with a more efficient use of the available space, as well as an increase in flow velocity in the distributing chamber, which naturally can then be of a lesser volume. The higher the flow velocity in the distribution chamber, the less the risk of accumulation of air or other gases, bacteria, slime and deposits.

The array of hydrocyclones shown in FIG. 8 has a housing in three parts, top, bottom and center. The central portion is in the form of a cylindrical casing 81, open at each end, with the top open end closed off by hemispherical section 83, and the bottom end closed off by hemispherical section 82. The bottom section 82 serves as the support for the casing 81 and top 83, and is designed to rest upon a foundation or frame (not shown) at flange 84. The flange 84a of the central portion 81 mates with flange 84 and supports the casing 81 and top 83 thereon. A leak-proof seal is provided between the bottom portion 82 and the casing 81 by a gasket (not shown). It is also possible to attach the casing 81 to the base part 82 by means of a threaded socket or joint.

The casing 81 and the top 83 preferably are in one piece, or are attached together so that they can be separated together from the bottom part 82, and lifted off, to provide access to the interior of the housing.

The casing 81 is provided with a plurality of uniformly distributed openings 85, corresponding in arrangement to the location of the individual hydrocyclones of the unit, and large enough in diameter so that a hydrocyclone can pass through. Each opening has a peripheral bayonet-type flange 85a which receives in a leaktight seal a matching bayonet type flange of a cap 92, thus closing off the openings and preventing leakage of fluid from the housing.

Within the casing 81 are disposed two concentric cylindrical shells 86, 87 and outside the casing 81 is a further cylindrical shell 88.

The annular space 123 between shells 86, 87 is closed off at each end, at the top by annular lid 90, and the bottom by the annular ring 91. The annular space 92 between shell 88 and housing is also closed off by bonding the shell to the housing at each end. Shell 88 has an array of openings 93 matching those of housing 81.

The casing can be provided with a lifting device (not shown) which extends downwardly from the top 83, to which it would be attached, within the central distribution chamber 130 of the cylinder 97, to a spider support attached to the bottom portion of the shell 87. The shells 86, 87 are supported at their bottom portions via support legs 94, which are attached to the bottom 82 of the housing. The lifting device would include a hydrualic motor, a hydraulic cylinder, and a reciprocable piston, the upper end of which would be connected with the top portion 83. Thus, operation of the lifting device could lift the top portion 83 up and away from the base portion 82, carrying with it the casing 81, providing access to the array of hydrocyclones, therewithin, attached to the shell 86 and housing 81.

It will be seen that the shell 86 and housing 81 serve as supports for the layers 111 of hydrocyclones 110, only one hydrocyclone of such layers, however, for the sake of simplicity, being shown in FIG. 8. The shell 86 is provided with apertures 86a, and within the apertures **85, 86*a*, are supported the individual hydrocyclones, which span the space 96, between the shells 86, 81 and are attached thereto, with the apex end 95 of each hydrocyclone at shell 86, and the base end at housing shell 81. These spaced apart shells thus define an annular inlet chamber 96, which is common to all of the hydrocyclones in a group, and gives access to the inlets 117 of each separator 110. The apex ends of the separators open into space 123 between shells 86, 87, the base ends open into annular chamber 126 between the inside of shell 88 and the outside of the casing shell 81.**

Spanning the space 126 between shells 81, 88 are the base end hydrocyclone caps 112, which are attached to the hydrocyclones, close off the base end, and provide a place for gripping the hydrocyclones to remove and insert them into the housing shells.

The spaces 123 and 126 extend from end to end between the shells 86 and 87, and 81 and 88.

It will be noted that the individual hydrocyclones 110 in each layer are arranged with their longitudinal axis radially disposed and perpendicular to the walls of the shells 86, 81. All of the hydrocyclones are arranged with the apex ends anchored in shell 86, and the base ends in shell 81. The apex ends of the hydrocyclones open into a common outlet chamber 123 provided with an outlet 98. The common base outlet chamber 126 for all the layers of hydrocyclones has an outlet 99.

This arrangement of hydrocyclones allows more hydrocyclones in each group to be fitted in the space between the shells 86 and 81.

Each aperture in shells 86, 81 is formed with an inwardly (or outwardly) extending flange 101, so as to provide a good press-fit between the hydrocyclones 110 and the shells. If desired, these can be fitted by a threaded socket. However, a good leak-tight fit is facilitated by the conical shape of the hydrocyclones and the flanges.

The inlets 117 of the hydrocyclones 110 are reached via the inlet chamber 96, which consequently forms a distribution chamber to the hydrocyclones. The inlet chamber 96 is open at the top and in fluid communication via the space 124 between the top 83 and lid 90 with the central space 120 within shell 87, and this communicates with inlet 118. There is also fluid communication via a plurality of passages 119 between support legs 94 at the bottom of chamber 96, which thus receives flow at each end from the inlet 118. The flow through chamber 96 is thus downflow in part, from the top space 124, to the uppermost layer of hydrocyclones in the array, and upflow in part, from passages 119, to the lowermost layer of hydrocyclones in the array. The two flows meet in the central portion of the chamber 96, and provide cross currents there, further improving circulation and fluid distribution through the chamber 96. The chamber 126 communicates directly with the base or cone end outlets of all the layers of hydrocyclones and thus constitutes a collecting space for the lighter fraction, which leaves the hydrocyclones at this end. This collection chamber is provided with an outlet 99.

In operation, the fluid material to be separated (composed of a liquid suspension of solid material) enters the casing housing 81 via the inlet conduit 118, and a part passes thence through the central passage 120 to the top 124 of the common distribution chamber 96, whence it flows by downflow into the distribution chamber 96, while a part flows via the passages 119 to the bottom of the distribution chamber 96 whence it flows by upflow through the chamber. It then enters the inlets 117 of the individual hydrocyclones 110, where it is separated by vortical forces into lighter and heavier fractions. The lighter fraction leaves the hydrocyclones via outlet 122 at the base end, enters the common collection chamber 126, and leaves the housing 81 via the outlet 99. The heavier fraction, discharged from the hydrocyclones 110 through the apex end outlet 125, enters the collection chamber 123, and passes thence to the outlet 98, where it emerges from the housing.

The hydrocyclone separator unit shown in FIG. 9 is similar to that of FIG. 4, and consequently, like parts are assigned like reference numerals. This unit also has an array of hydrocyclone separators 25 horizontally and radially disposed in four superimposed layers, with their apex ends facing the center.

The separator unit has an external cylindrical housing 37, within which are arranged two concentric frustoconical tubes **35*b*, 36*b*, placed inversely. Inner tube 35*b* is conical convergently from bottom to top, and outer tube 36*b* is conical divergently from bottom to top. The cylindrical housing 37 and the cones 35*b*, 36*b*, are provided with a plurality of apertures 35*a*, 36*a*, 37*a*, through which pass the individual hydrocyclone separators 25**, which accordingly are supported thereby.

Within the inner tube 35*b* is a central feed tube 26, in fluid flow connection with the inlet 26'. The feed tube 26 proceeds from the bottom nearly to the top wall 32 of the housing 37, where it is in fluid flow connection with the distribution chamber 27*b* defined by tubes 35*b*, 36*b*. The inlets 3 of the individual hydrocyclone separators 25 are in fluid-flow connection with the distribution chamber 27*b*. Because of the inversely conical arrangement of the tubes 35*b*, 36*b*, the distribution chamber 27*b* diminishes in cross-sectional diameter from top to bottom, accommodating the reduced flow of fluid from top to bottom of the chamber, as fluid enters the inlets 3.

Between the tube 36*b* and housing 37 is a collection chamber 30*b*, which is in fluid flow connection with the outlets 5 at the base end of the individual hydrocyclone separators 25. Because the tube 36*b* is inversely conical, the collection chamber 30*b* increases in cross-sectional diameter from the top to the bottom. The chamber 30*b* serves as a collection chamber for the accepts or light fraction emerging at the base end outlets 5, and accordingly provides a greater volume for the accepts fraction as the volume of accepts increases towards the bottom of the chamber 30*b*.

Between the inlet tube 26 and the innermost conical tube 35*b* is defined a collection chamber 28*b*, for rejects fraction passing through the apex outlets 4 of the hydrocyclone separators 25. This chamber increases in cross-sectional diameter from the top to the bottom, due to the conical configuration of the tube 35*b*, thus accommodating the increasing volume of rejects fraction from the apex outlets 4 of the hydrocyclone separators 25.

It will now be seen that the conicity of tubes 35*b*, 36*b* is selected to maintain flow rate in chambers 27*b*, 30*b*, 28*b*, as fluid enters and is discharged from the hydrocyclone separators 25.

At the base of the housing 37 is an outlet 31 in fluid flow connection with the collection chamber 30*b* and an outlet 29 in fluid flow connection with the collection chamber 28b, as well as the inlet 26'.

At the top of the housing 37 are provided outlet 27' controlled by valve 27*a* in fluid flow connection with the distribution chamber 27*b*, outlet 28' controlled by valve 28*a* in fluid flow connection with the apex outlet collection chamber 28*b*, and outlet 30' controlled by valve 30*a* in fluid flow connection with the collection chamber 30*b*. Except for the outlets, the top 32 of the housing 37 is closed off. The outlets allow the escape of air and other gases, which would otherwise collect at the top of the various chambers.

If desired, the inlet and outlets can also be provided with such valves as shown in FIG. 1.

In operation, fluid to be fractionated such as an aqueous cellulose pulp suspension is passed through the inlet 26' into and through the tube 26 to the top of the housing, whence it is distributed to the top of the distribution chamber 27*b*, through which it proceeds by downflow at a uniform rate over the individual hydrocyclone separators 25 in the array to the bottom of the array. As it does so, fluid enters the individual hydrocyclones through the inlets 3, the tangential arrangement of the inlets imparting a cyclonic movement to such fluid as it does so. Within the hydrocyclone separators the fluid is fractionated, and the light fraction or accepts passes through the openings 5 at the base end of the hydrocyclones into the collection chamber 30*b*, whence the fluid leaves through the accepts outlet 31. The heavier fraction or rejects passes through the apex end outlets 4 of the individual hydrocyclone separators into the collection chamber 28*b*, whence it leaves through the rejects outlet 29.

As the fluid to be fractionated passes downwardly through the distribution chamber 27*b*, the flow remains uniform, because the loss of fluid into the hydrocyclone separators 25 through the inlets 3 is compensated for by the reducing volume of distribution chamber 27*b*, which is sufficient to maintain the flow rate in the distribution chamber 27*b* to the bottom of the apparatus.

The hydrocyclones as well as the housings and component parts thereof in accordance with the invention can be formed of any suitable material that is resistant to attack or corrosion by the gas or liquid mixtures to be separated under the operating conditions. Metals can be used, such as stainless steel and aluminum, and nickel and chromium alloys, as well as ceramic, glass and plastic materials that are strong, resistant to pressure, and capable of retaining their shape under the pressures to be encountered. Such materials can be shaped or molded by injection or compression molding into the shapes desired, and can be manufactured in quantity without detriment. Materials such as glass, porcelain, nylon, polytetrafluoroethylene, polyesters, polycarbonates, polyethylene, polypropylene, synthetic rubbers, phenol-formaldehyde, ureaformaldehyde, and melamine-formaldehyde resins are suitable, as well as polyoxymethylene and chlorotrifluoroethylene polymers, as well as polyurethane polymers.

In the preferred embodiment of hydrocyclone, a tubular baffle extends from the base outlet into the chamber to a point beyond the gas inlet or inlets, to deflect flow away from the base outlet, and enhance initiation of a vortex at the base end, and thence through the chamber towards the apex end. The tangential orientation of the one or more inlets imparts a cyclonic or vortical flow to the fluid being introduced. The inlets should be uniformly spaced if there is more than one, for initiation of a uniform vortical flow. Usually, from two to six inlets are sufficient. Then, when the fluid is introduced into the chamber at high velocity, it is constrained by the curved walls of the separator chamber into a vortex which flows helically towards the apex end or peripheral portion outlet end of the chamber.

The cone shape of the separator chamber (and vortex) is quite significant in improving separation efficiency. The chamber must decrease in diameter towards the apex end, reducing the radius of the vortex and increasing centrifugal force. A cone shape is therefore essential. The chamber can be in the form of a straightsided right angle cone from base end to apex end. It can also be partly cylindrical, and cone-shaped only at the apex end. The cone shape need not be uniform or straight sided. Convexly and concavely curved sides can be used, of uniform or increasing or decreasing curvature. The diameter can decrease continuously towards the apex end, or in stages. Thus, a variety of cone shapes are possible, and the shape chosen will depend on the particular conditions of the separation to be carried out, and may be determined by trial-and-error experimentation.

The hydrocyclones in the array can be arranged for flow of accept fraction to the base outlet and of reject fraction to the axial outlet, if the heavier fraction is the reject fraction, or for flow of reject fraction to the base outlet and of accept fraction to the axial outlet, if the lighter fraction is the reject fraction. Both lighter and heavier fractions can be accept fractions, if the hydrocyclone is used for fractionation of accept fraction into lighter and heavier accept fractions.

In the case where the fluid is to be subjected to a number of vortex stages, it is advantageous to employ an array of hydrocyclones, arranged in two series, in cascade. A typical cascade series which can be used is described by Avery, *Physics Bulletin* (1970), page 18. The core portion from each hydrocyclone stage is separated and combined in series with the apex portion from a later hydrocyclone stage, and this repeated at each stage to the end of the series, while in the other series, the apex portions are separated and sent through with the core portions from a later stage. Any arrangement of the hydrocyclones and the feedback can be used. In this way, no part of the material need be wasted, and eventually all of the components separated can be recovered, if desired.

A cascade series can be arranged within the apparatus of the invention simply by interconnecting the hydrocyclones of adjacent groups in a manner such that the core portions from each group are separated and combined in series with the apex portions from a later group, and this is repeated with each group to the end of the series, while in the other series (which may, if desired, be composed of a group of adjacent hydrocyclones within the same housing) the apex portions are separated and sent through with the core portions at a later stage. The separate and distinct series of hydrocyclones can be arranged by compartmenting off vertical radial banks of groups of hydrocyclones.

In the separator units shown in the drawings, the outer shell also serves as the support for the outer ends of the individual hydrocyclone separators in the array. Since the outside ends of the separators are closed, there is no need for an external housing. However, if desired, an outer shell or casing can be provided, enclosing the entire unit, including the outer shell shown in the Figures. This outer casing can be arranged to be lifted by a hydraulic or pneumatic lifting device, so as to give access to the separators of the array, in the manner described in U.S. Pat. No. 3,261,467, the disclosure of which is hereby incorporated by reference. If this is done, then the extension members 38, 42 can also be eliminated, and the hydrocyclone separators arranged to project only slightly beyond the next innermost shell, in FIG. 2, tube 8; in FIG. 3, tube 22*b;* in FIG. 4, tube 36; and in FIG. 6, tube 46; in which event the outermost shell need not be provided with apertures, and can therefore serve as the outer housing shell.

In the drawings, the hydrocyclone separators are placed horizontally. However, the separators can also be placed with their geometric axes at an angle to the horizontal, as described and claimed in U.S. Pat. No. 3,747,306 patented July 24, 1973.

It is also possible to have the distribution chambers arranged with a reduced volume (in the case of annular chambers, a reduced diameter) at the lower portion of the unit. Thus, the distribution chamber has a decreasing cross-sectional area in the flow direction. In so doing, the separator walls can be set at an angle so that the collection chambers at the same time are of an increasing cross-sectional area, in the flow direction. In this way, the flow velocity in the main flow direction can be kept constant through the distribution and collection chambers. In general, the flow velocity through the distribution and collection chambers should not be less than 0.3 meter per second, and preferably is within the range from about 1 to about 3 meters per second.

It is also advantageous to provide for a higher pressure in the collection chamber for light fraction than in the collection chamber for heavy fraction. In the event that the inlet to the separator becomes obstructed, this will prevent heavy fraction from being transferred to the light fraction by way of the hydrocyclone. In order to achieve this, flow regulating means can be arranged in the outlets of the collection chambers, as shown in FIG. 2, as well as in the inlet to the distribution chamber, and the liquid levels in the distributing and collection chambers are then maintained so that these levels are above the uppermost layer of separators in the unit.

It is not necessary of course that the collection chambers for the light and heavy fractions be common to all layers of hydrocyclones in the unit. The outlets of the separators can also be arranged in groups, or separately to empty into a collection chamber provided with its own discharge outlet, for instance by having the units divided into sections by longitudinal or radial partition walls, these sections being in fluid flow connection in parallel or in series.

Having regard to the foregoing disclosure, the following is claimed as the inventive and patentable embodiments thereof:

1. A hydrocyclone separator unit comprising a housing; an array of hydrocyclones arranged in the housing in a plurality of more than two superimposed layers, in which layers the hydrocyclones are at least approximately horizontally oriented, each hydrocyclone having a conical vortex chamber having a base end provided with an inject inlet and a base outlet and an opposed apex end provided with an apex outlet; one of the base outlet and apex outlet constituting a reject outlet for reject flow, and the other an accept outlet for accept flow; a first wall in the housing along which the hydrocyclones are distributed in layers, one above the other; a first collection chamber in the housing common to and communicating with a plurality of the vortex chambers by way of the outlets at one end of the hydrocyclones; a second wall in the housing along which the hydrocyclones are distributed in layers, one above the other; a second collection chamber in the housing common to and communicating with a plurality of the vortex chambers by way of the outlets at the other end of the hydrocyclones; a distribution chamber in the housing intermediate the first and second walls common to and communicating with a plurality of the vortex chambers by way of the inject inlets; and means for feeding at least 25% up to 100% of the liquid suspension to be fractionated to the uppermost of the layers of the hydrocyclones in the housing via the distribution chamber so as to proceed by downflow, descending from the uppermost of the superimposed hydrocyclone layers to each of the layers of hydrocyclones therebelow; a first outlet in the first collection chamber, and a second outlet in the second collection chamber; the first and second outlets each being adjacent the bottom of the first and second collection chambers, respectively, and receiving and delivering flow from the collection chambers only by downflow.

2. An apparatus according to claim 1 in which both the apex and the base outlets are axial.

3. An apparatus according to claim 1 in which the base outlet is lateral and the apex outlet axial.

4. An apparatus according to claim 1 in which the hydrocyclones in the layers are arranged radially in the array about a central axis, with the apices facing towards the central axis.

5. An apparatus according to claim 1 in which the hydrocyclones are arranged radially in the array about a central axis, with the apices facing the outer periphery of the array.

6. An apparatus according to claim 1 in which the hydrocyclones are arranged in superimposed parallel layers.

7. An apparatus according to claim 1 in which the collection chambers are provided with outlets arranged at their bottoms.

8. An apparatus according to claim 6 in which the hydrocyclones are arranged in parallel rows in each layer, with the hydrocyclones in adjacent layers offset for closer spacing.

9. An apparatus according to claim 6 in which the hydrocyclones are radially arranged about a common geometric axis.

10. An apparatus according to claim 9 in which the collection and distribution chambers are annularly arranged about the common geometric axis.

11. An apparatus according to claim 10 in which one collection chamber is arranged annularly within the distribution chamber and the other collection chamber is arranged annularly outside the distribution chamber.

12. An apparatus according to claim 11 in which the hydrocyclones are arranged with their apices discharging into the innermost collection chamber which thereby receives the heavy fraction.

13. An apparatus according to claim 11 in which the hydrocyclones are arranged with their apices discharging into the outermost collection chamber which thereby receives the heavy fraction.

14. An apparatus according to claim 1 in which gas outlets are provided at the tops of the distribution and collection chambers.

15. An apparatus according to claim 1 in which flow regulating means is arranged in at least one of the inlet and outlet lines enabling the maintenance in the distribution and collection chambers of fluid levels above the uppermost layer of hydrocyclones in the unit.

16. An apparatus according to claim 1 comprising means for the maintenance of a higher pressure in the collection chamber for the light fraction than in the collection chamber for the heavy fraction.

17. An apparatus according to claim 1 in which at least one of the first and second separating walls is provided with apertures large enough for the hydrocyclones to pass through and sealing means for providing a fluid-tight seal at the apertures.

18. An apparatus according to claim 17 in which the sealing means comprise flanges arranged on the hydrocyclones.

19. An apparatus according to claim 17 in which the sealing means are attached to the wall.

20. An apparatus according to claim 1 in which the hydrocyclones are provided with at least two tangentially directed inlet openings uniformly spaced about the periphery of the vortex chamber.

21. An apparatus according to claim 1, in which the reject outlets of the hydrocyclone vortex chambers include a transparent section for detection of a change in the reject flow.

22. An apparatus according to claim 21 in which the transparent section is coaxial with each reject outlet.

23. An apparatus according to claim 21 in which the transparent section includes a door which can be opened in the vicinity of a reject outlet and through which door at least one vortex chamber can be cleaned.

24. An apparatus according to claim 23 in which the door carries the transparent section.

25. An apparatus according to claim 21 in which the outlets of the hydrocyclone vortex chambers project through the walls.

26. A hydrocyclone separator unit comprising a housing; an array of hydrocyclones arranged in the housing in a plurality of more than two superimposed parallel layers, in which layers the hydrocyclones are at least approximately horizontally oriented, each hydrocyclone having a conical vortex chamber having a base end provided with an inject inlet and a base outlet and an opposed apex end provided with an apex outlet; one of the base outlet and apex outlet constituting a reject outlet for reject flow, and the other an accept outlet for accept flow; a first wall in the housing along which the hydrocyclones are distributed in layers, one above the other; a first collection chamber in the housing common to and communicating with a plurality of the vortex chambers by way of the outlets at one end of the hydrocyclones; a second wall in the housing along which the hydrocyclones are distributed in layers, one above the other; a second collection chamber in the housing common to and communicating with a plurality of the vortex chambers by way of the outlets at the other end of the hydrocyclones; a distribution chamber in the housing intermediate the first and second walls common to and communicating with a plurality of the vortex chambers by way of the inject inlets; and an inlet feed channel extending from the bottom to the upper part of the distribution chamber for feeding at least 25% up to 100% of the liquid suspension to be fractionated to the uppermost of the layers of the hydrocyclones in the housing via the distribution chamber so as to proceed by downflow, descending from the uppermost of the superimposed hydrocyclone layers to each of the layers of hydrocyclones therebelow.

27. A hydrocyclone separator unit comprising a housing; an array of hydrocyclones arranged in the housing in a plurality of more than two superimposed layers, in which layers the hydrocyclones are at least approximately horizontally oriented, each hydrocyclone having a conical vortex chamber having a base end provided with an inject inlet and a base outlet and an opposed apex end provided with an apex outlet; one of the base outlet and apex outlet constituting a reject outlet for reject flow, and the other an accept outlet for accept flow; a first wall in the housing along which the hydrocyclones are distributed in layers, one above the other; a first collection chamber in the housing common to and communicating with a plurality of the vortex chambers by way of the outlets at one end of the hydrocyclones; a second wall in the housing along which the hydrocyclones are distributed in layers, one above the other; a second collection chamber in the housing common to and communicating with a plurality of the vortex chambers by way of the outlets at the other end of the hydrocyclones; a distribution chamber in the housing intermediate the first and second walls common to and communicating with a plurality of the vortex chambers by way of the inject inlets; a fluid flow connection between the distribution chamber at the bottom thereof and the collection chamber for heavy fraction at the bottom thereof; and means for feeding at least 25% up to 100% of the liquid suspension to be fractionated to the uppermost of the layers of the hydrocyclones in the housing via the distribution chamber so as to proceed by downflow, descending from the uppermost of the superimposed hydrocyclone layers to each of the layers of hydrocyclones therebelow.

28. A hydrocyclone separator unit comprising a housing; an array of hydrocyclones arranged in the housing in a plurality of more than two superimposed layers, in which layers the hydrocyclones are at least approximately horizontally oriented, each hydrocyclone having a conical vortex chamber having a base end provided with an inject inlet and a base outlet and an opposed apex end provided with an apex outlet; one of the base outlet and apex outlet constituting a reject outlet for reject flow, and the other an accept outlet for accept flow; a first wall in the housing along which the hydrocyclones are distributed in layers, one above the other; a first collection chamber in the housing common to and communicating with a plurality of the vortex chambers by way of the outlets at one end of the hydrocyclones; a second wall in the housing along which the hydrocyclones are distributed in layers, one above the other; a second collection chamber in the housing common to and communicating with a plurality of the vortex chambers by way of the outlets at the other end of the hydrocyclones; a distribution chamber in the housing intermediate the first and second walls common to and communicating with a plurality of the vortex chambers by way of the inject inlets; the crossectional area of the distribution chamber diminishing and the cross-sectional area of the collection chambers increasing from top to bottom of the housing, corresponding to the change in fluid volume therealong with fluid flow to or from the hydrocyclones, so that in the flow direction at least approximately constant flow velocity is maintained in the distribution chamber and the collection chambers; and means for feeding at least 25% up to 100% of the liquid suspension to be fractionated to the uppermost of the layers of the hydrocyclones in the housing via the distribution chamber so as to proceed by downflow, descending from the uppermost of the superimposed hydrocyclone layers to each of the layers of hydrocyclones therebelow.

29. A hydrocyclone separator unit comprising a housing; an array of hydrocyclones arranged in the housing in a plurality of more than two superimposed parallel layers, in which layers the hydrocyclones are at least approximately horizontally oriented, and radially arranged about a common geometric axis, each hydrocyclone having a conical vortex chamber having a base end provided with an inject inlet and a base outlet and an opposed apex end provided with an apex outlet; one of the base outlet and apex outlet constituting a reject outlet for reject flow, and the other an accept outlet for accept flow; a first wall in the housing along which the hydrocyclones are distributed in layers, one above the other; a first collection chamber in the housing common to and communicating with a plurality of the vortex chambers by way of the outlets at one end of the hydrocyclones; a second wall in the housing along which the hydrocyclones are distributed in layers, one above the other; a second collection chamber in the housing common to and communicating with a plurality of the vortex chambers by way of the outlets at the other end of the hydrocyclones; a distribution chamber in the housing intermediate the first and second walls common to and communicating with a plurality of the vortex chambers by way of the inject inlets; the collection and distribution chambers being annularly arranged about the common geometric axis, one collection chamber being arranged annularly within the distribution chamber and the other collection chamber being arranged annularly outside the distribution chamber; a fluid flow connection in the housing below the lowermost of the superimposed hydrocyclone layers for feeding liquid suspension to be fractionated by upflow thereto; and means for feeding at least 25% up to 100% of the liquid suspension to be fractionated to the uppermost of the layers of the hydrocyclones in the housing via the distribution chamber so as to proceed by downflow, descending from the uppermost of the superimposed hydrocyclone layers to each of the layers of hydrocyclones therebelow.

30. In the process for fractionating liquid suspensions in an array of hydrocyclones arranged in a plurality of more than two superimposed layers, in which layers the hydrocyclones are at least approximately horizontally oriented, the hydrocyclones having an elongated vortex chamber having an accept end provided with an inject inlet and an accept outlet, and an opposed reject end provided with a reject outlet, which includes passing the liquid suspension into the elongated vortex chamber, fractionating the liquid suspension in the vortex chamber so as to product an accept and a reject fraction which are separated at the accept outlet and reject outlet, respectively, and then separately collecting the accept and reject fractions, the improvement which comprises feeding at least 25% up to 100% of the liquid to be fractionated to the inject inlets of the hydrocyclones in the uppermost layer of the superimposed layers of the array so as to proceed at least in major proportion by downflow from the uppermost to the lowermost of the superimposed layers of hydrocyclones.

31. A process in accordance with claim 30 in which the liquid is fed to the inject inlets at an average flow velocity within the range from about 0.3 to about 3 meters per second.

32. A process in accordance with claim 30 in which a part of the liquid suspension is fed by upflow to the hydrocyclones in the array.

* * * * *